US011806788B2

(12) United States Patent
Champion et al.

(10) Patent No.: US 11,806,788 B2
(45) Date of Patent: Nov. 7, 2023

(54) SINTERING FURNACE

(71) Applicant: Hewlett-Packard Development Company, L.P., Spring, TX (US)

(72) Inventors: David Champion, Corvallis, OR (US); Pavan Suri, Corvallis, OR (US); John Liebeskind, Corvallis, OR (US); Richard Seaver, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 470 days.

(21) Appl. No.: 17/059,072

(22) PCT Filed: Nov. 26, 2018

(86) PCT No.: PCT/US2018/062499

§ 371 (c)(1),
(2) Date: Nov. 25, 2020

(87) PCT Pub. No.: WO2020/112083

PCT Pub. Date: Jun. 4, 2020

(65) Prior Publication Data

US 2021/0213525 A1 Jul. 15, 2021

(51) Int. Cl.

| | |
|---|---|
| ***B22F 3/10*** | (2006.01) |
| ***F27D 7/02*** | (2006.01) |
| ***F27B 5/18*** | (2006.01) |
| *F27D 19/00* | (2006.01) |

(52) U.S. Cl.

CPC ..... *B22F 3/1007* (2013.01); *F27D 7/02* (2013.01); *B22F 2998/10* (2013.01); *F27D 2019/0006* (2013.01); *F27D 2019/0028* (2013.01)

(58) Field of Classification Search

CPC ..... F27D 5/0031

See application file for complete search history.

(56) References Cited

U.S. PATENT DOCUMENTS

| | | | | |
|---|---|---|---|---|
| 4,719,073 | A | 1/1988 | Langan | |
| 5,225,155 | A * | 7/1993 | Hampton | F27D 5/0062 419/57 |
| 6,031,207 | A * | 2/2000 | Dover | B22F 3/003 219/400 |
| 6,125,687 | A | 10/2000 | McClelland et al. | |
| 8,692,202 | B2 | 4/2014 | Johnson et al. | |

(Continued)

FOREIGN PATENT DOCUMENTS

| | | | |
|---|---|---|---|
| CN | 101093142 | A | 12/2007 |
| EP | 3222953 | A1 | 9/2017 |

(Continued)

*Primary Examiner* — Steven S Anderson, II

(74) *Attorney, Agent, or Firm* — SHOOK, HARDY & BACON L.L.P.

(57) ABSTRACT

In an example implementation, a sintering system includes a detection gas line to enable gas to flow into a sintering furnace from an external gas supply. The system includes a detection gas port inside the furnace through which gas from the detection gas line is to flow into the furnace, and a registration feature inside the furnace to enable positioning of a token green object proximate the gas detection port. The system includes a gas flow monitor to detect changes in gas flow through the detection gas line when the token green object shrinks during a sintering process in the furnace.

14 Claims, 9 Drawing Sheets

(56) References Cited

U.S. PATENT DOCUMENTS

| | | | | |
|---|---|---|---|---|
| 8,932,381 | B2 | 1/2015 | Zeller | |
| 9,120,045 | B2 | 9/2015 | Wieslander et al. | |
| 9,459,194 | B2 | 10/2016 | Benner et al. | |
| 2006/0219168 | A1* | 10/2006 | Brcka | C23C 16/4481 118/726 |
| 2009/0136884 | A1 | 5/2009 | Jepson | |
| 2016/0137558 | A1* | 5/2016 | Watanabe | C04B 35/64 264/630 |
| 2017/0082365 | A1* | 3/2017 | Crafton | F27D 5/00 |
| 2017/0130287 | A1 | 5/2017 | Takahashi et al. | |
| 2017/0144223 | A1 | 5/2017 | Gold et al. | |
| 2017/0182598 | A1 | 6/2017 | Crear et al. | |

FOREIGN PATENT DOCUMENTS

| | | | |
|---|---|---|---|
| JP | H01195204 | A | 8/1989 |
| JP | 05-117711 | A | 5/1993 |
| WO | WO0174518 | A2 | 10/2001 |
| WO | WO03070402 | A1 | 8/2003 |
| WO | WO2018101645 | A1 | 6/2018 |
| WO | WO-2020112082 | A1 | 6/2020 |
| WO | WO-2020139325 | A1 | 7/2020 |

* cited by examiner

SINTERING FURNACE

BACKGROUND

Powder metal manufacturing processes such as MIM (metal injection molding) and binder jetting produce metal objects from powdered metal materials. Such processes include preparing "green objects" that comprise a powdered metal and a binder. The binder material can be removed from a green object during a binder burnout phase of a sintering process, and the powdered metal can then be consolidated and densified in the sintering process to improve the strength and integrity of the object. Sintering processes, such as pressurized sintering and atmospheric (pressureless) sintering, expose green objects to high temperatures for predetermined periods of time to bond the powdered metal particles together. During the sintering process, objects are brought up to an appropriate sintering temperature that is below the melting point of the metal powder, and the objects are maintained at the sintering temperature according to a predetermined time-temperature profile.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
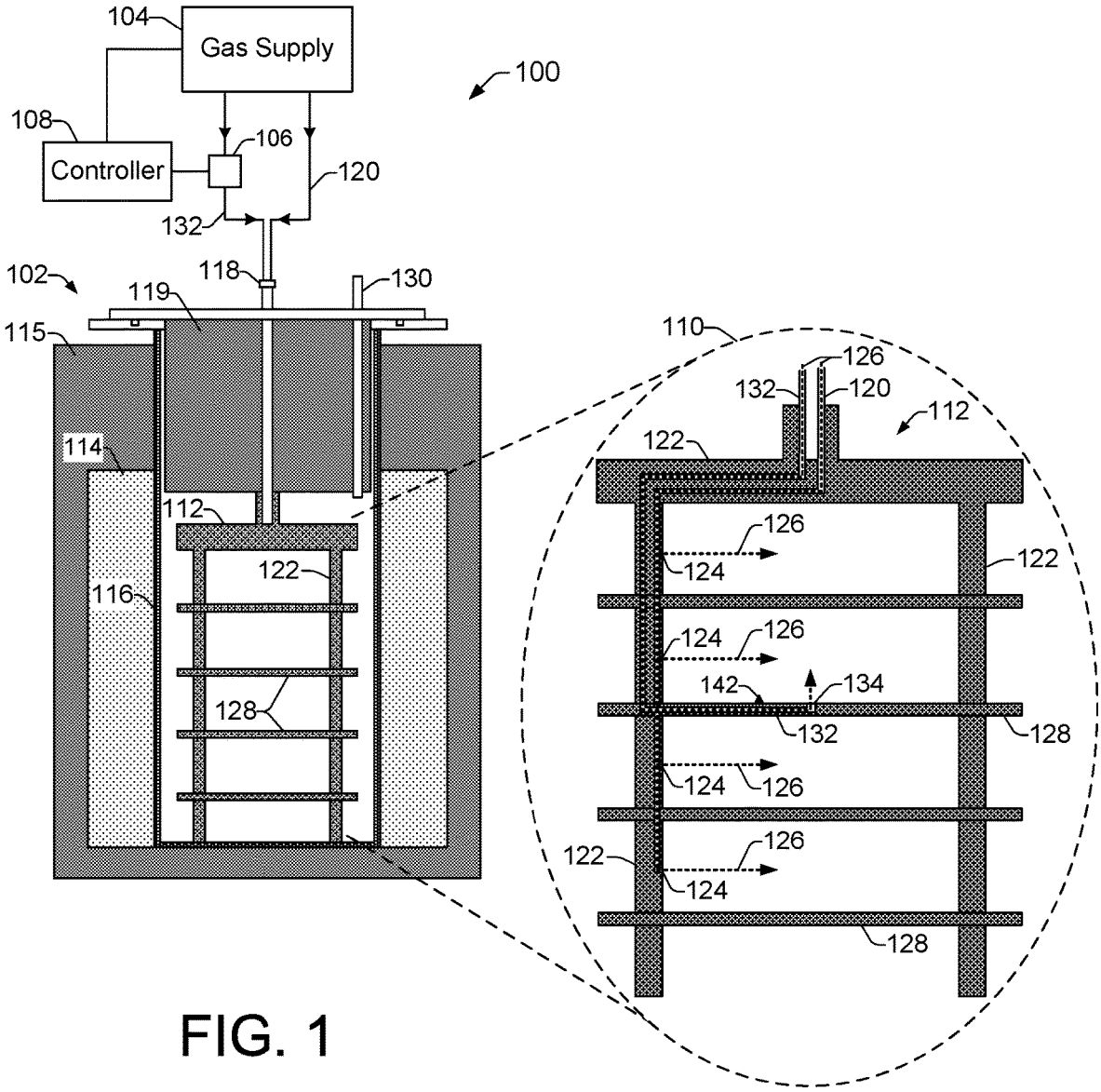
FIG. 1 shows a block diagram of an example sintering furnace system suitable for detecting the endpoint of a sintering process.

Sintering is a heat treatment process often used to improve mechanical and other properties of "green" state objects or parts produced by different manufacturing methods such as binder jet 3D printing and MIM (metal injection molding) processes. A green object is an object whose material is in a weakly bound state, such as weakly bonded powder material before it has been sintered or fired. Sintering processes expose "green" objects to high temperatures for predetermined periods of time. Time-temperature profiles for sintering processes are generally determined based on experimentation with properties including the material type, material density, wall thickness, and total mass and general thermal load of the green objects to be sintered. Such profiles are designed to control the heating and cooling cycles of the sintering process so that the green objects within a furnace load are exposed to the proper sintering temperature for the correct amount of time that will bring the objects to a sintering endpoint or completion. However, determining such time-temperature profiles can be costly due to, for example, variations in thermal properties of different materials, variations in total thermal mass between different sintering runs, the matching of thermocouples to the process gas being used, and so on. In addition, the time-temperature profiles merely provide an indirect method for estimating when a sintering endpoint will be reached. Therefore, controlling sintering cycles based on predetermined time-temperature profiles can result in suboptimal quality among the sintered objects within a given sintering furnace load.

In some examples, a sintering furnace can be loaded with green objects and programmed with a particular time-temperature profile to control the heating and cooling cycle of the furnace. The time-temperature profile for a given furnace load is generally determined through trial and error based on the expected thermal load of the green objects to be sintered, which considers the mass of the load as well as the dimensional and material characteristics of the objects, as noted above. However, a furnace load can include green objects with varying characteristics, such as objects that have different thermal loads and/or different sizes, shapes, and thicknesses. In some 3D printing processes, such as binder jetting, for example, there can be a significant degree of variability among the green objects that are produced within different printing batches or within the same printing batch. Therefore, the profiles for controlling sintering cycle times are often developed to accommodate the worst-case scenario. Worst-case scenarios can be determined based on green objects that are expected to have the greatest thermal loads, the thickest object sections, and/or the types of metal powder materials that call for the longest furnace sintering times.

Because sintering cycle times are usually developed to accommodate green objects that represent such worst-case scenarios, other green objects within a same furnace load are often exposed to longer sintering times that can extend well beyond their sintering endpoints. Extended sintering times can result in over-sintering of some objects and can degrade the quality and performance of the sintered objects, as well as increase the costs associated with operating the sintering furnace, including additional time, energy, and furnace wear and tear.

As noted above, during the sintering process green objects are brought up to an appropriate sintering temperature for predetermined periods of time to achieve the sintering endpoint or completion. Sintering temperatures are generally some percentage of the melting point temperature of the metal material being sintered. For example, sintering temperatures can be on the order of 70%-90% of the melting point. Measuring and monitoring furnace temperatures to ensure that the correct sintering temperature is reached and sustained at the center of the furnace "hot zone" can be challenging and costly.

The primary method for monitoring temperature in a sintering furnace involves the use of thermocouples, which can add significant cost to the sintering process. Thermocouples are application specific devices because they must be matched with the process gas and the temperatures being used for sintering the green object materials within a furnace load. In addition, thermocouples are typically located on the outside of the thermal mass cluster and are ideally routed to the center of the furnace hot zone to provide the most accurate temperature information. Furthermore, it should be noted that even when thermocouples can be used to provide accurate temperature monitoring and control over predetermined time periods, such accurate implementation of time-temperature profiles is not a definitive method for determining when a sintering endpoint has been reached. Rather, such accurate control provides at best, an indirect method for estimating when the sintering endpoint has been reached. As a result, sintering times are often extended to ensure that the worst-case objects in a furnace load reach a sintering endpoint which, as noted above, can cause over-sintering of some objects within the furnace load.

Accordingly, example sintering devices described herein improve the accuracy of sintering cycle times by enabling the monitoring of a sintering process within a furnace and detecting a sintering endpoint (i.e., sintering completion). A gas flow detection channel routed to an endpoint detection port within the sintering furnace can be monitored during a sintering process to determine changes in gas flow through the channel, including changes in gas pressure, changes in the rate of gas flow, and changes in the resistance to gas flow, for example. Such changes in gas flow within the channel can be detected during the sintering process when a token green object shrinks or experiences other dimensional changes that can open up or block the endpoint detection port. When a target gas flow (e.g., gas flow rate, pressure, resistance) is detected in the gas flow detection channel, a controller can determine that the sintering endpoint (i.e., the sintering completion point) has been reached for the token green object, as well as for other green objects in the furnace that are being sintered along with the token object. The sintering process can then cycle from a furnace heating phase to a furnace cool down phase. Thus, instead of controlling sintering cycles based on a predetermined time-temperature profile designed to estimate a sintering endpoint, devices and methods described herein enable more accurate control over sintering cycles through monitoring a gas flow that can indicate actual sintering endpoints. Optimizing sintering cycle times helps to improve object characteristics such as toughness and dimensional tolerances, as well as provides for greater energy efficiency and cost savings with sintering furnaces.

In a particular example, a sintering system includes a detection gas line to enable gas to flow into a sintering furnace from an external gas supply. The system further includes a detection gas port inside the furnace through which gas from the detection gas line is to flow into the furnace, and a registration feature inside the furnace to enable positioning of a token green object proximate the gas detection port. The system includes a gas flow monitor to detect changes in gas flow through the detection gas line when the token green object shrinks during a sintering process in the furnace. A controller can determine when changes in gas flow detected by the gas flow monitor reach a target value that indicate that the token green object and other green objects in the furnace have reached a sintering endpoint.

In another example, a sintering furnace includes a rack with a frame and shelves to support green objects within the volume of the furnace. A gas supply line is routed through the frame to provide a continuous gas flow over the green objects. A monitored gas detection line is routed through the frame and through a shelf to provide a monitored gas flow to a detection port formed in the shelf. An alignment datum is disposed on the shelf to guide placement of a token green object onto the shelf at a location near the detection port so that deformation of the token green object during a sintering process changes the orifice size of the detection port and causes a change in the monitored gas flow.

In another example, a sintering furnace rack includes a shelf to support objects to be sintered in a sintering furnace, and a frame to support the shelf. A detection gas line formed in the frame, extends partially through the shelf to provide gas flow to a port that is formed in the shelf. A registration feature on the shelf is to guide a token object to a location on the shelf that is proximate the port such that deformation of the token object during a sintering process alters the port size and changes the gas flow through the detection gas line.

Figure 2:
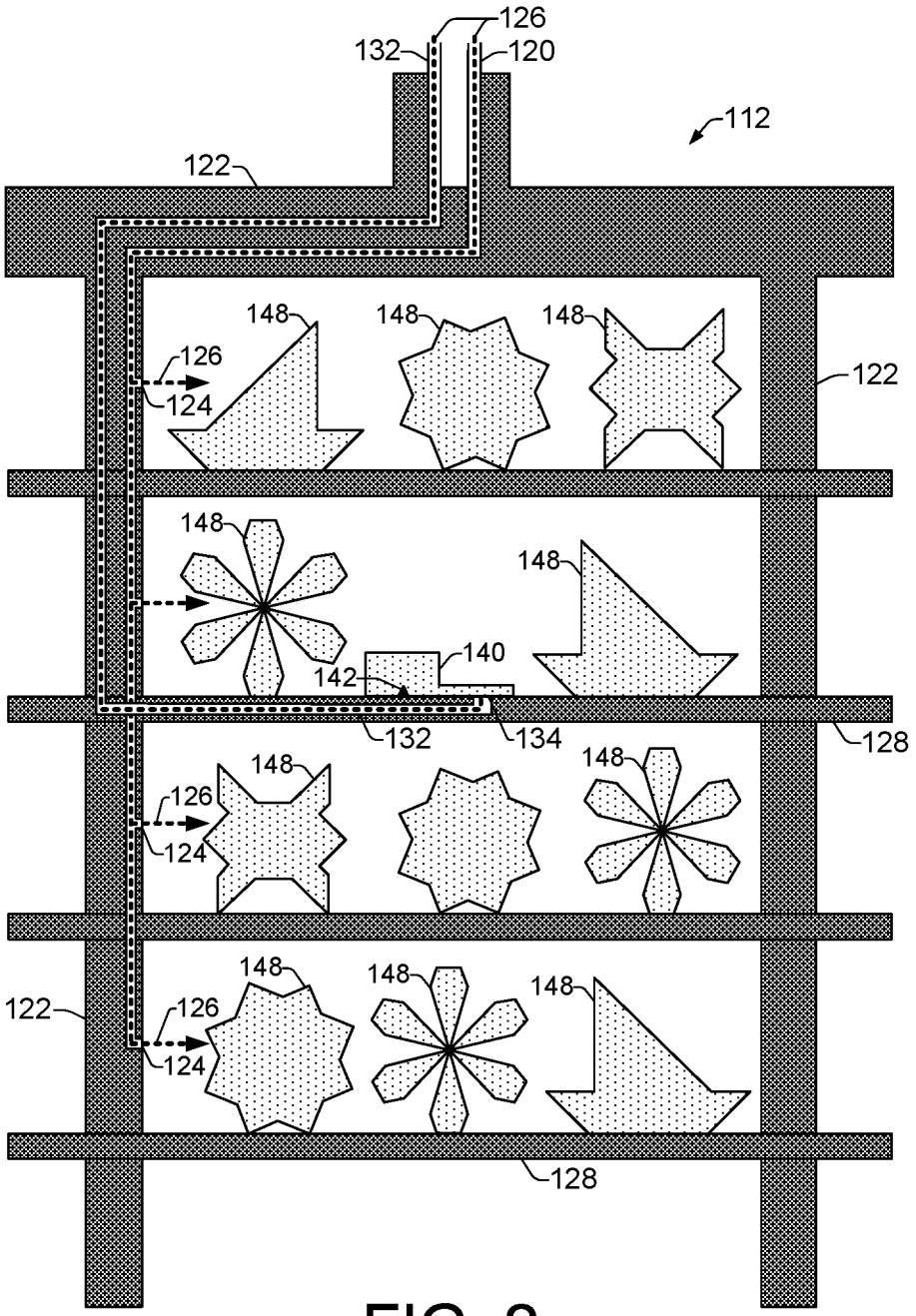
FIG. 2 shows an enlarged view of an example furnace rack loaded with an example token green object and other example green objects for sintering.

FIG. 1 shows a block diagram of an example sintering furnace system 100 suitable for detecting the endpoint of a sintering process and providing accurate sintering cycle times. The system 100 includes an example sintering furnace 102, a gas supply 104, a gas flow monitor 106, and a controller 108. FIG. 1 includes an enlarged view 110 of an example furnace rack 112 that can support green objects inside the furnace 102 during a sintering process. FIG. 2 shows an additional view of the example furnace rack 112 that has been loaded with an example token green object 140 and other example green objects 148 for sintering.

Referring generally to FIGS. 1 and 2, the example sintering furnace 102 is sometimes referred to as a "hot wall" design where electric heating elements 114 or other heating sources are located inside the furnace 102 between a layer of insulation 115 and the furnace retort wall 116. The retort wall 116 can be made from different materials including a refractory metal, ceramic, quartz, or other materials capable of withstanding high temperatures. Peak sintering temperatures in the furnace can depend on the type of material being sintered, with an example range of such temperatures reaching as high as between 1100° C. to 1400° C. In an example sintering process, once the green objects 140, 148 (sometimes referred to as the "load" or "furnace load") are loaded into the furnace on the rack 112, the controller 108 can activate the heating elements 114 to begin heating the retort 116. The retort 116 can conduct or radiate the heat to the objects within the furnace.

During a sintering process, gas 126 from a supply 104 can be introduced into the furnace atmosphere. In some examples, a sintering process includes a binder burnout phase where binder material (e.g., plastics) in the green objects 140, 148, is broken down by high temperatures, and the broken down components of the binder material are removed by the gas 126 as it flows across the objects. The binder burnout phase can occur during the sintering process, for example, when the temperature within the furnace reaches approximately 400° C. A variety of gases can be introduced into the furnace including, for example, hydrogen, nitrogen, and carbon monoxide. Hydrogen gas is often introduced to serve as a reducing agent that helps keep the powder metal particles in the green objects 140, 148, from oxidizing and removes other contaminants. The hydrogen reduction process helps the surfaces of the metal particles remain metallic which improves the strength of bonds that are created between particles during sintering.

During a sintering process, gas 126 from a supply 104 can flow uniformly and continually through a gas inlet 118 and into the furnace retort 116. The gas inlet 118 can be formed in, and can pass through, the door 119 or lid of the furnace 102. A main gas line 120 can pass through the gas inlet 118 of the furnace and be routed through the frame 122 of the furnace rack 112. The main gas line 120 can be further routed to multiple gas flow openings 124 or gas inlet ports 124 formed within the frame 122. A continual supply of gas 126 (shown as a dashed line running inside the main gas line 120) can be delivered into the furnace retort 116 through the gas flow openings 124 to flow over the green objects 140, 148, that are positioned on the shelves 128 of the furnace rack 112. In some examples, a fan (not shown) may be provided inside the retort 116 to circulate the atmosphere. The pressure of the gas 126 as it flows into the furnace retort 116 through gas flow openings 124 pushes the atmosphere within the retort 116 out of the furnace through a gas outlet 130 located in the door 119 of the furnace 102. The atmosphere being pushed out of the furnace through the outlet 130 generally comprises gas, along with different elements being carried within the gas, such as the broken down components of the binder material, and the contaminants and water vapor that are generated by a hydrogen reduction process.

In addition to the continual flow of gas 126 through the main gas line 120 and into the furnace retort 116 through gas flow openings 124, gas can also flow into the retort 116 through a separate detection gas line 132. Like the main gas line 120, the detection line 132 can enter the furnace through the gas inlet 118 and can be routed through the frame 122 of the furnace rack 112. The detection line 132, however, is then further routed through a shelf 128 on the rack 112. The detection gas line 132 travels through the shelf 128 toward the center of the retort 116 to an area of the furnace sometimes referred to as the furnace hot zone. The detection gas line 132 terminates at a detection gas port 134 formed in the shelf through which gas can enter into the furnace retort 116.

As discussed below with further reference to FIGS. 3-6, changes in the gas flow through the detection gas line 132 and through the detection port 134 can be monitored by a gas flow monitor 106 and a controller 108. In different examples, a gas flow monitor 106 can comprise different types and/or combinations of monitors such as a gas flow rate monitor and a gas pressure monitor. Thus, a gas flow monitor 106 can monitor different aspects of gas flow through the gas line 132, such as the gas flow rate and/or the gas pressure. Therefore, in some examples the gas supply 104 can be controlled to provide a constant gas pressure into the detection gas line 132, and the gas flow monitor 106 can measure changes in gas flow rate through the line 132. In other examples, the gas supply 104 can include a mass flow controller to provide a constant gas flow rate into the gas line 132, and the gas flow monitor 106 can measure changes in gas pressure within the gas line 132. In different examples, based on data from the gas flow monitor 106, a controller 108 can determine if predetermined gas flow targets are reached, such as a target gas flow rate or a target gas pressure. When a target gas flow rate or pressure is detected, the controller 108 can adjust the furnace cycle for optimum sintering. More specifically, when a predetermined target gas flow rate or pressure is detected, the controller 108 can determine that green objects 148 in the sintering furnace have reached a sintering endpoint, and the controller 108 can initiate a furnace cooling phase by deactivating the heating elements 114, for example.

Figure 3:
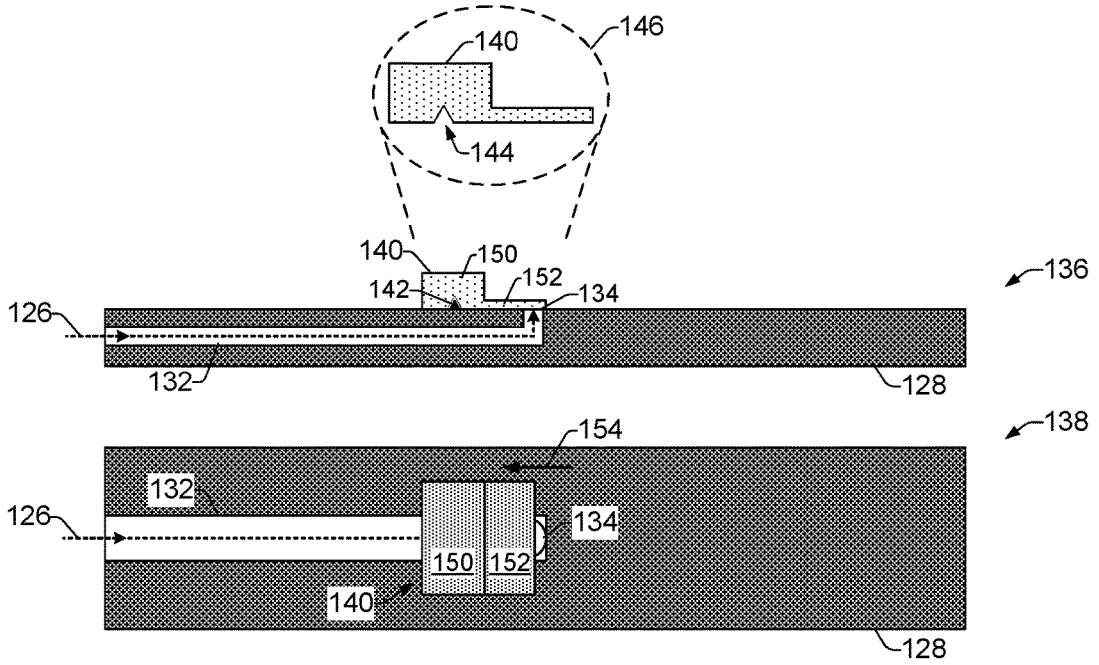
FIG. 3 shows an enlarged side view and top view of an example shelf from a furnace rack.

FIG. 3 shows an enlarged side view 136 and top view 138 of an example shelf 128 from the furnace rack 112. An example of a token sacrificial green object 140 is shown positioned on the shelf 128 in close proximity to the detection gas port 134. More specifically, the token green object 140 is positioned on the shelf 128 in accordance with registration features formed on the shelf 128 and the token object 140. As shown in FIG. 3, as well as in FIGS. 1 and 2, the example shelf 128 includes a protruding registration datum 142 that has been designed onto the shelf 128 to enable accurate and consistent placement of a token green object 140 onto the shelf 128. The example token green object 140 can be produced with an appropriate registration notch 144 that mirrors the registration datum 142 to facilitate the accurate placement of the token object 140 on the shelf 128. FIG. 3 includes an enlarged view 146 of the token object 140 where an example registration notch 144 can be seen more clearly. The registration features shown on the shelf 128 and the token object 140 in FIGS. 1-6 are shown by way of example, and they are not intended to limit the extent to which other similar registration features may be implemented. In other implementations, for example, the registration datum on the shelf 128 may comprise an indentation or notch, while the token object 140 may comprise a protruding feature such as a peg that mirrors the notch so the peg can fit into the notch and provide an accurate and consistent placement of token objects 140 onto the shelf 128.

The example token green object 140 is a sacrificial object that can be produced in the same manufacturing process batch as other green objects 148 being sintered within the same furnace load as the token object 140, as shown in FIG. 2. As noted above, FIG. 2 shows an example of a furnace rack 112 loaded with objects that include both a token green object 140 and a number of other green objects 148 that are to be sintered in a same sintering process. The token object 140 has been produced in a same manufacturing process as the green objects 148, such as in the same 3D binder jetting process or the same MIM process. The token object 140 is therefore materially and mechanically representative of the green objects 148. For example, both the token object 140 and green objects 148 can comprise the same type of powder metal material having the same material density and particle sizes. In addition, both the token object 140 and green objects 148 will have had the same binder material added during the manufacturing process, and both will have been exposed to the same processing steps during manufacturing. In a 3D binder jetting process, for example, both the token object 140 and other green objects 148 will undergo the same procedures such as powder layering, binder jetting, and radiation exposure using the same powder metal materials, the same binder liquid, the same binder liquid droplet sizes, the same radiation intensity, and so on.

Because the token green object 140 and green objects 148 comprise the same type of powder material with the same density and particle sizes, they behave in the same or similar manner during the sintering process. That is, during sintering, the green objects 148 undergo the same material densification and dimensional contraction as the token object 140. While the token object 140 may not be the same shape or size as the green objects 148, the token object 140 can be designed to match the average wall thickness of the green objects 148 to be sintered. Nevertheless, the sintering time of objects does not change significantly based on the relative thickness or size of the objects. Rather, the main factors that determine sintering times are the density of the object and the material type and particle size distribution of the material. The object thickness and size are of less significance in affecting sintering times because the time constants for heat transfer are smaller than the time constants for sintering. Thus, the time to heat both a small and large object, or a thin and thick object, is mostly insignificant in comparison to the time it takes the objects to begin densification during the sintering process. Therefore, the sintering time for a smaller object such as a token object 140, is very close to the sintering time for a larger object such as the green objects 148 shown in FIG. 2. Consequently, dimensional changes in the token object 140 can be used to indicate corresponding changes in the green objects 148 throughout the sintering process, including indicating the point when the sintering process reaches an endpoint. As discussed below, changes in gas flow through the detection gas port 134 caused by such dimensional changes in the token object 140 during sintering can be monitored and used to indicate when the green objects 148 have reached a sintering endpoint.

Figure 4A:
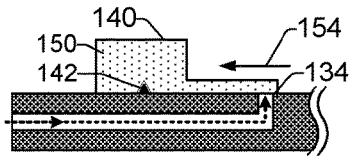
FIG. 4A shows a side view of an example token object positioned on an example furnace shelf at a location that covers up a detection gas port.
Figure 4B:
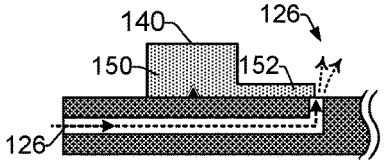
FIG. 4B shows a side view of an example token object positioned on the example shelf after shrinkage has occurred from a sintering process.
Figure 4C:
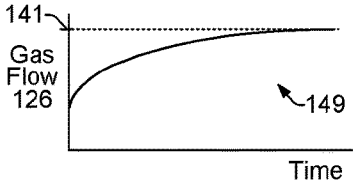
FIG. 4C shows an example graph of gas flow through a detection gas line versus time during a sintering process.

Referring now primarily to FIG. 3 and FIG. 4 (illustrated as FIGS. 4A, 4B, 4C), the registration features formed on the shelf 128 and the token object 140 ensure the accurate and consistent placement of an example token green object 140 in a location on the shelf 128 that is proximate the detection gas port 134. FIG. 4A shows a side view of the example token object 140 positioned on the example shelf 128 at a location that covers up, or blocks, the detection gas port 134 prior to a sintering process. Therefore, prior to sintering, a gas flow monitor 106 (FIG. 1) can initially measure low or zero gas flow through the detection gas line 132. FIG. 4B shows a side view of the example token object 140 positioned on the example shelf 128 after shrinkage has occurred from a sintering process. The densification and deformation (i.e., shrinkage) of the token object 140 during sintering uncovers and unblocks the gas port 134, effectively changing the orifice size of the gas port 134, so that gas can flow into the furnace retort 116 through the port 134 and gas line 132. The change in gas flow through the detection gas line 132 can be monitored by the gas flow monitor 106 and controller 108, as shown in FIG. 1.

FIG. 4C shows an example plot or graph 149 of gas flow through the detection gas line 132 versus time during a sintering process. The graph 149 shows that as the token object 140 shrinks over time, it uncovers more and more of the detection gas port 134, which allows increasing amounts of gas to flow through the gas line 132. The gas flow continues to increase until the token object 140 stops shrinking, at which point the gas flow maintains a steady flow rate, or target flow rate 141. In some examples, when a gas flow monitor 106 detects a target flow rate 141 through the gas line 132, such as a steady gas flow rate, the controller 108 can determine that the green objects 148 in the furnace 102 have reached a sintering endpoint. Upon determining that a sintering endpoint has been reached, the controller 108 can then cycle the sintering process from a furnace heating phase to a furnace cool down phase.

As noted above, in some examples a gas flow monitor 106 can monitor gas pressure within the gas line 132 instead of, or in addition to, monitoring the gas flow rate. In such examples, a controller 108 can determine when changes in the gas pressure occur and/or when a target gas pressure is reached. Detecting changes or targets in gas flow rates or gas pressure within the gas line 132 can provide information about the extent of shrinkage occurring in the green objects 148 and the progress of the sintering process. Based on the changes in the gas flow, the controller 108 can determine when the sintering process has reached an endpoint and can adjust the sintering cycle accordingly.

In general, different examples of token green objects 140 can comprise a stationary feature 150 that can be secured in place on the shelf 128 by the registration features (142, 144), and a moveable feature 152 that is free to move during sintering as the token object 140 shrinks and deforms. As shown in FIGS. 3 and 4, the stationary feature 150 can comprise a larger "body" portion 150 of the token object 140, and the moveable feature 152 can comprise a smaller "arm" portion 152 of the token object 140. In different examples, the moveable feature 152 (e.g., the arm 152) of the token object 140 can be free to move in different directions that cause changes in gas flow through the gas port 134, such as in a horizontal direction indicated by the direction arrow 154 shown in FIGS. 3 and 4.

Figure 5A:
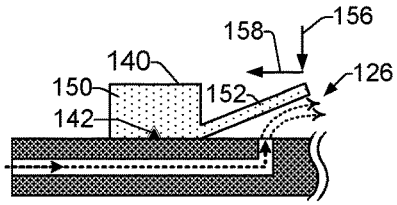
FIG. 5A shows a side view of an example token object positioned on a furnace shelf at a location near a detection gas port.
Figure 5B:
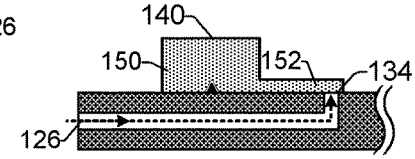
FIG. 5B shows a side view of an example token object positioned on an example shelf after shrinkage and sagging have occurred from a sintering process.
Figure 5C:
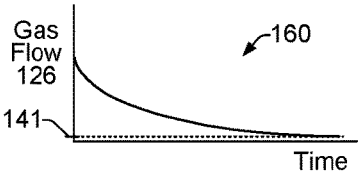
FIG. 5C shows an example graph of gas flow through a detection gas line versus time during a sintering process.

FIG. 5 (illustrated as FIGS. 5A, 5B, 5C) shows another example of token green objects 140 that can be used in a sintering process to cause changes in gas flow into the furnace 102. FIG. 5A shows a side view of an example token object 140 positioned on a furnace shelf 128 at a location near the detection gas port 134. The example token object 140 in FIG. 5 is similar to the token object 140 of FIG. 4 discussed above, in that it comprises a stationary feature 150 (i.e., a body 150) that can be secured in place on the shelf 128 by registration features (142, 144), and a moveable feature 152 (i.e., an arm 152) that is free to move during sintering as the token object 140 shrinks and deforms. However, unlike the token object 140 of FIG. 4, the moveable feature 152 of the token object 140 of FIG. 5 does not initially cover up or block the detection gas port 134 prior to a sintering process. Instead, the moveable feature 152 extends from the stationary feature 150 at an angle that positions the moveable feature 152 above the gas port 134 prior to sintering. This enables gas 126 to flow into the furnace in an unobstructed manner prior to sintering. During sintering, the densification and deformation of the token object 140 causes the moveable feature 152 to sag downward under the force of gravity as indicated by the downward arrow 156. The moveable feature 152 can also move inward (horizontally) toward the stationary feature 150 as indicated by direction arrow 158. As the sintering progresses, the moveable feature 152 gets increasingly closer to the gas port 134 and begins to restrict and reduce gas flow through gas port 134. Eventually, as the sintering process nears and/or reaches completion, the moveable feature 152 covers up the gas port 134, which blocks the port and prevents gas from flowing into the furnace through the port as shown in FIG. 5B.

FIG. 5B shows a side view of the example token object 140 positioned on the example shelf 128 after shrinkage and sagging have occurred from a sintering process. As noted above, the change in gas flow through the gas port 134 and detection gas line 132 can be monitored by the gas flow monitor 106 and controller 108, as shown in FIG. 1. FIG. 5C shows an example graph 160 of gas flow through the detection gas line 132 versus time during a sintering process based on the token object 140 in FIGS. 5A and 5B. The graph 160 shows that as the token object 140 shrinks over time, it sags and covers up more and more of the detection gas port 134, which reduces the gas flow through the gas line 132. The gas flow continues to decrease until the token object 140 stops shrinking and the moveable feature 152 is resting on top of the gas port 134, blocking the flow of gas through the port 134. In some examples, detection of the reduced and/or blocked gas flow through the gas line 132 can be used as a target gas flow 141 by the controller 108 to determine that the green objects 148 in the furnace 102 have reached a sintering endpoint. In response to determining that a sintering endpoint has been reached, the controller 108 can adjust the sintering process by deactivating heating elements 114 and initiating a furnace cool down phase.

FIG. 6 (illustrated as FIGS. 6A, 6B, 6C, 6D) shows yet another example of a token green object 140 that can be used in a sintering process to cause changes in gas flow into a sintering furnace 102. FIG. 6A shows a cross-sectional side view of an example token object 140 positioned on a furnace shelf 128 at a location over the detection gas port 134. FIG. 6B shows a cross-sectional side view of the example token object 140 after it has undergone a sintering process. FIG. 6C shows a top view of the example token object 140 in an initial state 164 before sintering, and in a shrunken state 166 after the object 140 has reached a sintering endpoint. As shown in FIGS. 6A, 6B, and 6C, the example token object 140 comprises an annular shape with a base 144 that serves as a registration feature 144, and a cylindrical conduit 162 that allows gas 126 to flow into the furnace through the gas port 134. The shelf 128 comprises a corresponding protruding registration feature 142 that encircles the gas port 134 and enables the accurate and consistent placement of the token object 140 on the shelf 128 over the gas port 134. Prior to sintering, gas 126 can flow unobstructed through the cylindrical conduit 162 as shown in FIG. 6A. During sintering, the token object 140 densifies and shrinks as indicated by direction arrows 167, and the reduced diameter of the cylindrical conduit 162 from the shrinking restricts the flow of gas 126, as shown in FIG. 6B.

Figure 6A:
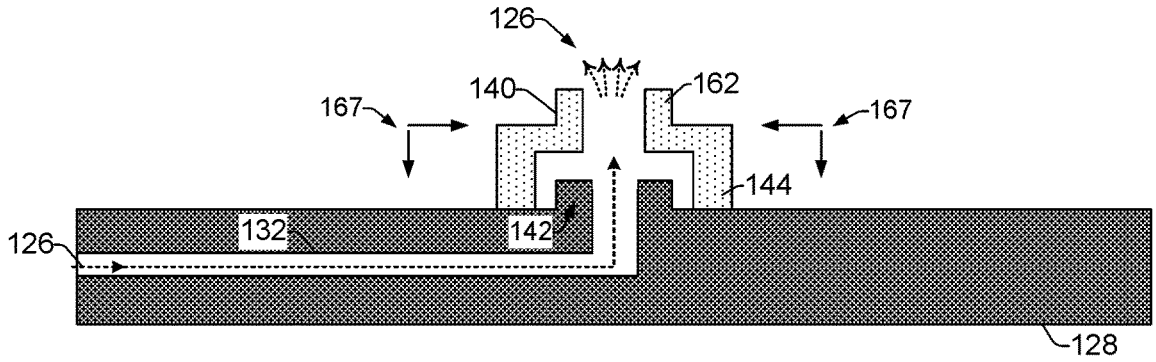
FIG. 6A shows a cross-sectional side view of an example token object positioned on a furnace shelf at a location over a detection gas port.
Figure 6B:
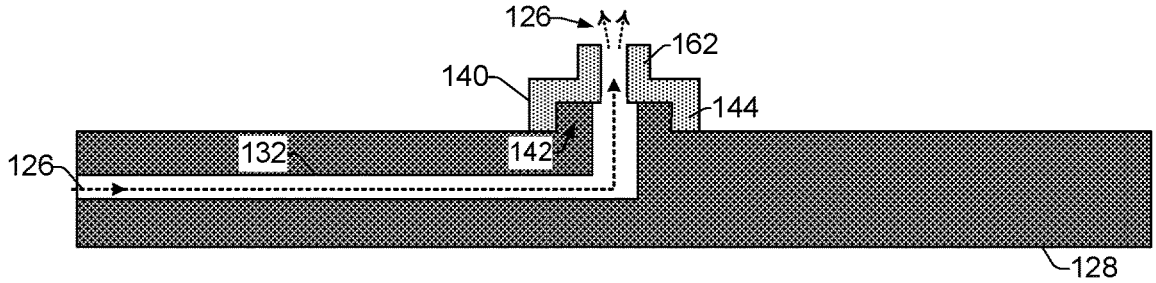
FIG. 6B shows a cross-sectional side view of an example token object after it has undergone a sintering process.
Figure 6C:
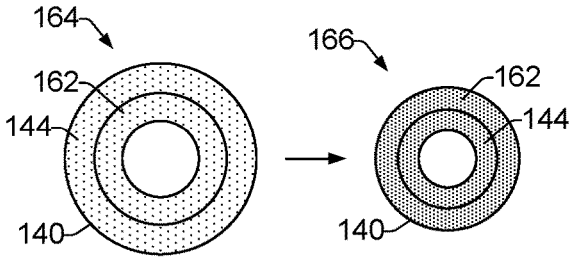
FIG. 6C shows a top view of an example token object in an initial state before sintering, and in a shrunken state after the object has reached a sintering endpoint.
Figure 6D:
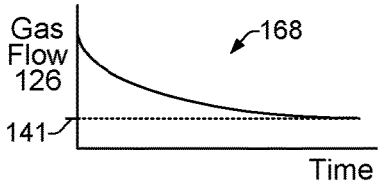
FIG. 6D shows an example graph of gas flow through a detection gas line versus time during a sintering process.

FIG. 6D shows an example graph 168 of gas flow through the detection gas line 132 versus time during a sintering process that uses the example token object 140 in FIGS. 6A, 6B, and 6C. The graph 168 shows that as the token object 140 shrinks over time, the cylindrical conduit 162 of the object 140 gets narrower and reduces the gas flow coming into the furnace through the gas port 134 from the gas line 132. The gas flow through the gas line 132 continues to decrease until the token object 140 stops shrinking, at which point the gas flow remains at a steady rate 141 as shown in the graph 168. In some examples, detecting a steady gas flow rate 141 by the gas monitor 106 serves as a target for the controller 108 that indicates that the sintering of the green objects 148 (FIG. 2) has reached an endpoint. The controller 108 can then deactivate heating elements 114 in the furnace to begin a furnace cool down phase.

Figure 7A:
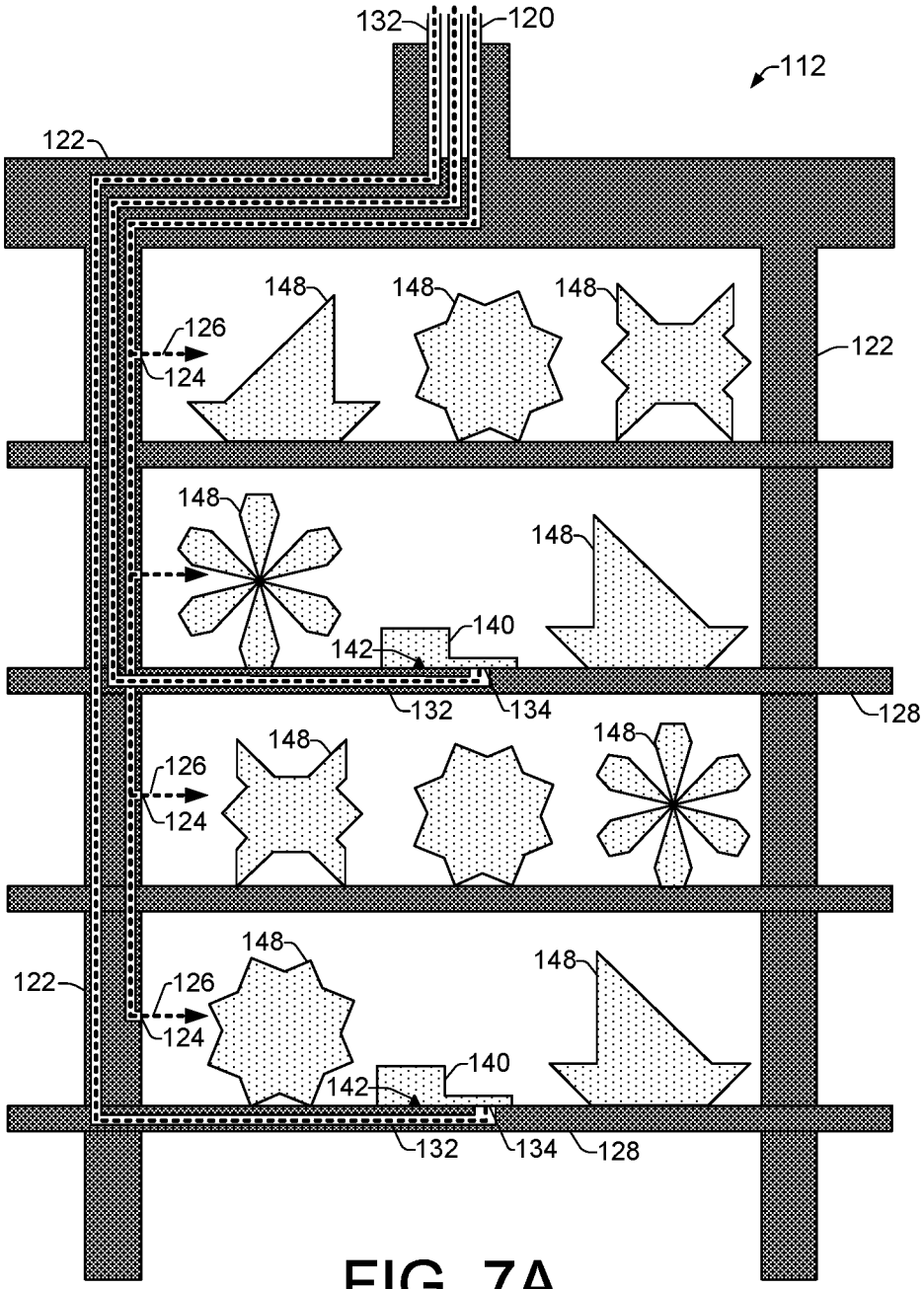
FIG. 7A shows an example furnace rack that includes multiple gas detection lines.
Figure 7B:
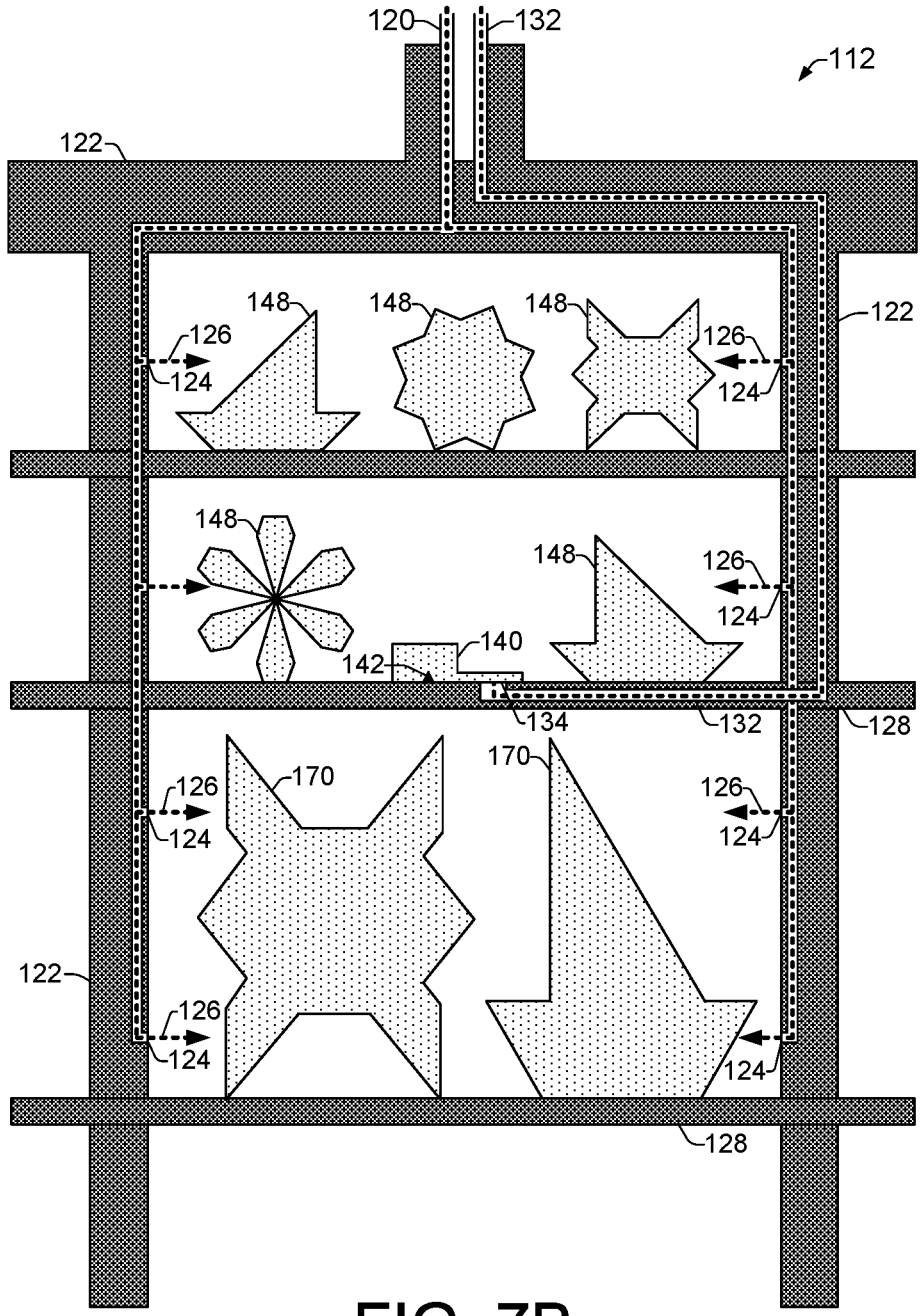
FIG. 7B shows another example furnace rack that includes a main gas line routed through both sides of a frame.

While a particular example furnace rack 112 for a sintering furnace 102 has been illustrated and described above with respect to FIGS. 1 and 2, the furnace rack 112 is not limited to such an example. In other examples, a furnace rack 112 may have different features such as a different number of shelves 128, additional gas detection lines 132 routed through a number of shelves 128 to a number of different detection gas ports 134, and so on. FIG. 7A, for example, shows a furnace rack 112 that includes multiple gas detection lines 132 that are routed through the frame 122 of the furnace rack 112 and through different shelves 128 leading to separate detection gas ports 134. In this example, a different token green object 140 can be positioned relative to each of a number of detection gas ports 134 and can alter the gas flow through the port as it shrinks and deforms in a sintering process as discussed above. The gas flow through each port and associated detection gas line 132 can be monitored for gas flow changes that provide an indication to the controller 108 that the sintering process has reached an endpoint with respect to the green objects 148 being sintered. FIG. 7B shows another example furnace rack 112 that includes the main gas line 120 routed through both sides of the frame 122 and having multiple gas flow openings 124 to provide gas flow over the green objects from multiple sides of the frame 122. The example rack 112 in FIG. 7B also shows a gas detection line 132 routed through a different side of the frame 122 in the furnace rack 112 than the previous examples. The example rack 112 in FIG. 7B also shows adjustable shelves 128 that have been positioned in the frame 122 to provide a larger area to accommodate larger green objects 170.

FIGS. 8-11 are flow diagrams showing example methods 800, 900, 1000, and 1100, related to monitoring a sintering process. Method 900 comprises an extension of method 800 and thereby incorporates additional details of method 800. The methods are associated with examples discussed above with regard to FIGS. 1-7, and details of the operations shown in the methods can be found in the related discussion of such examples. The operations of the methods may be embodied as programming instructions stored on a memory of controller 108 and executable on controller 108.

Figure 8:
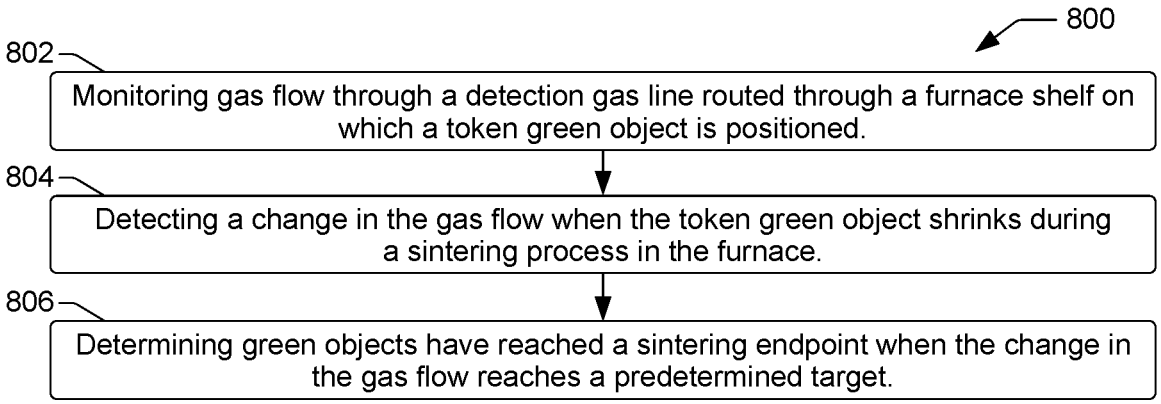
FIG. 8 shows a flow diagram of an example method of determining a sintering process endpoint.

Referring now to the flow diagram of FIG. 8, an example method 800 of determining a sintering process endpoint begins at block 802 with monitoring gas flow through a detection gas line that is routed into a sintering furnace and through a furnace shelf on which a token green object is positioned. The method includes detecting a change in the gas flow when the token green object shrinks during a sintering process in the furnace, and determining that the token green object and other green objects being sintered in the furnace with the token green object have reached a sintering endpoint when the change in the gas flow reaches a predetermined target, as shown at blocks 804 and 806.

Figure 9:
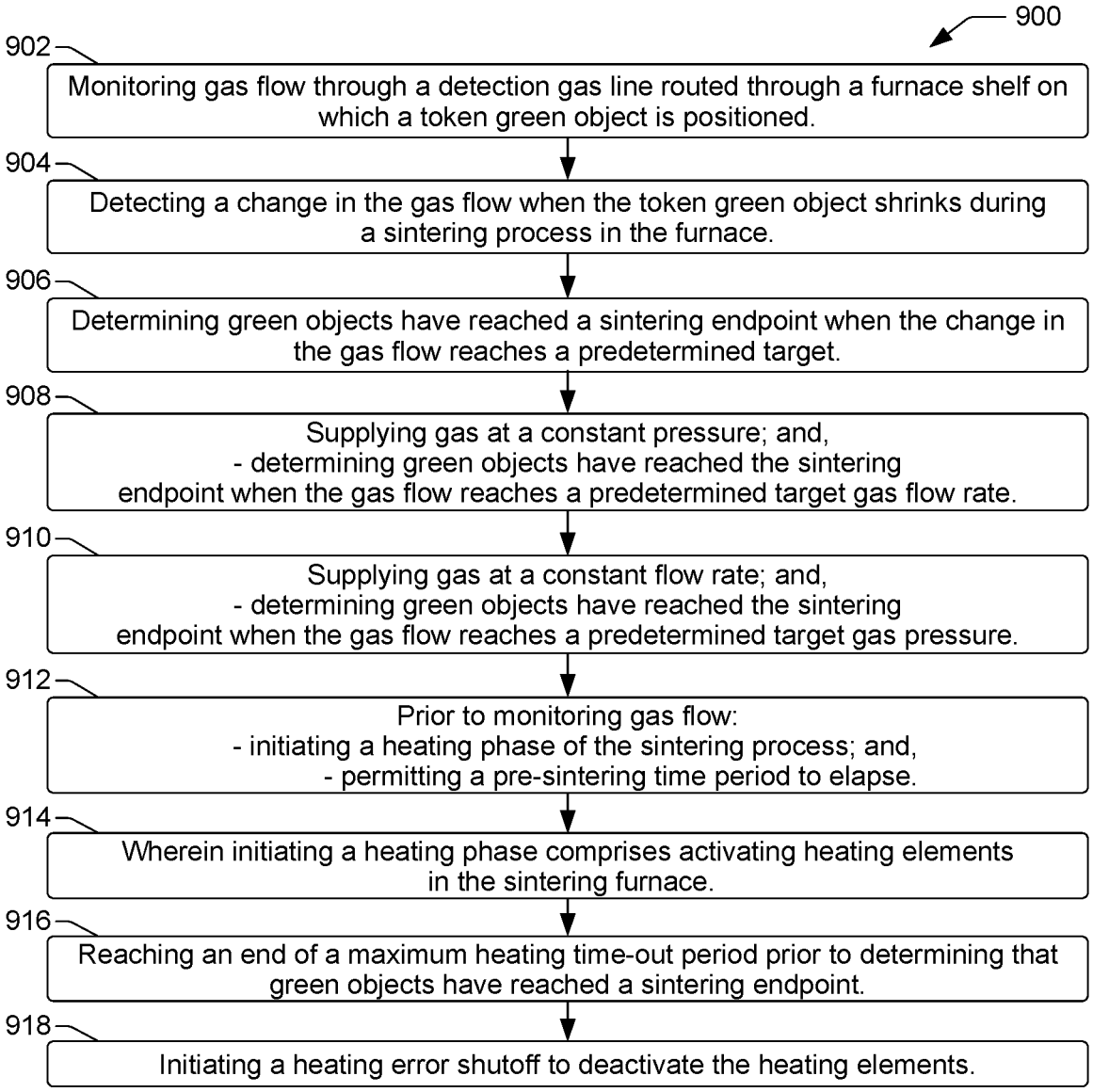
FIG. 9 shows a flow diagram of an example method of determining a sintering process endpoint.

Referring now to the flow diagram of FIG. 9, an example method 900 of determining a sintering process endpoint comprises an extension of method 800. Accordingly, like method 800, method 900 begins with monitoring gas flow through a detection gas line that is routed into a sintering furnace and through a furnace shelf on which a token green object is positioned, as shown at block 902. The method 900 includes detecting a change in the gas flow when the token green object shrinks during a sintering process in the furnace, and determining that the token green object and other green objects being sintered in the furnace with the token green object have reached a sintering endpoint when the change in the gas flow reaches a predetermined target, as shown at blocks 904 and 906. The method 900 can include supplying gas into the detection gas line at a constant gas pressure, and determining that the green objects have reached the sintering endpoint when the gas flow reaches a predetermined target gas flow rate, as shown at block 908. In some examples, the method can include supplying gas into the detection gas line at a constant flow rate, and determining that the green objects have reached the sintering endpoint when the gas flow reaches a predetermined target gas pressure, as shown at block 910. In some examples, the method can include initiating a heating phase of the sintering process and permitting a pre-sintering time period to elapse, prior to monitoring gas flow through a detection gas line (block 912). In some examples, initiating a heating phase can include activating heating elements in the sintering furnace (block 914). The method 900 can also include reaching an end of a maximum heating time-out period prior to determining that green objects have reached a sintering endpoint, and initiating a heating error shutoff to deactivate the heating elements (blocks 916, 918).

Figure 10:
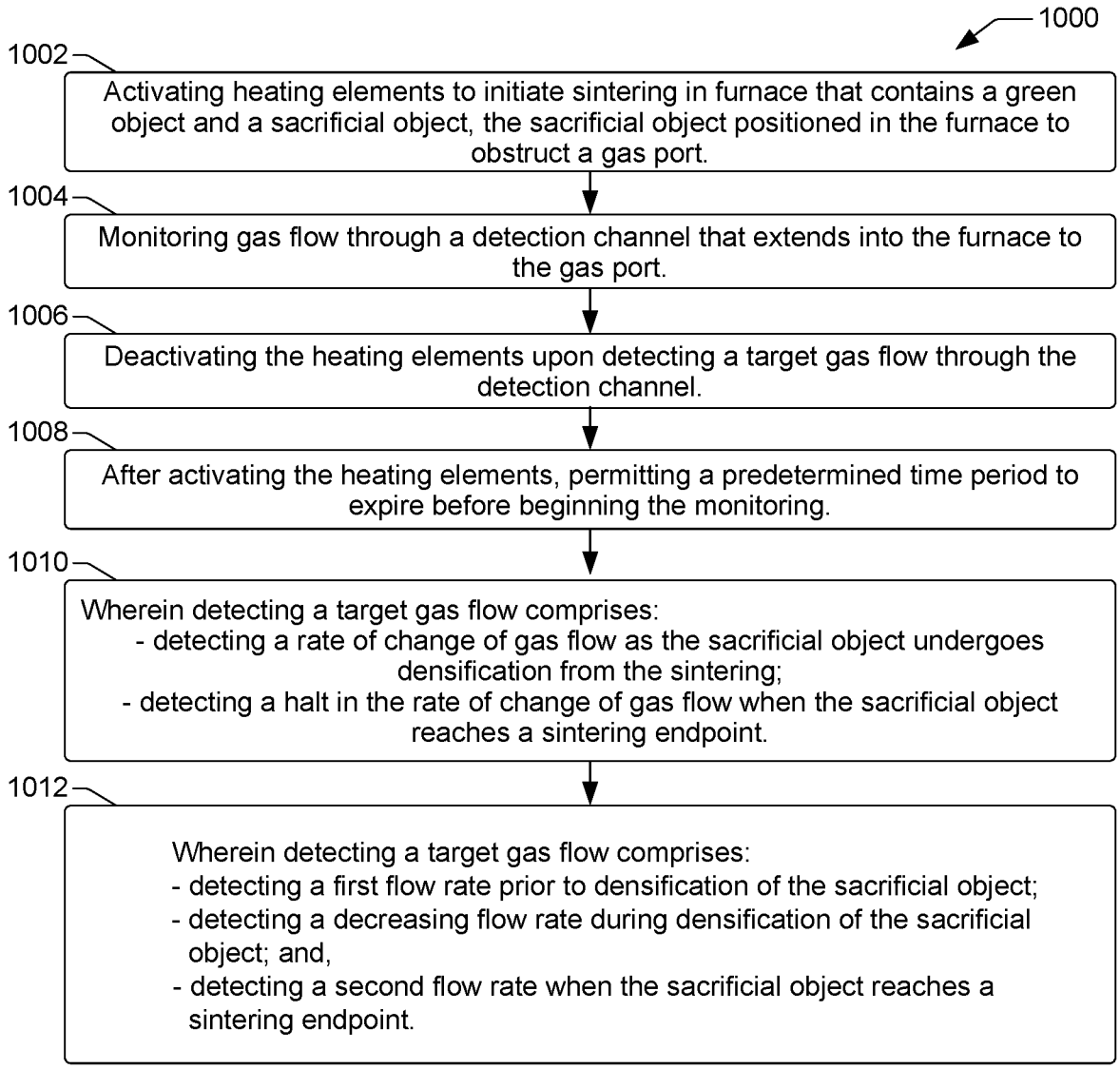
FIG. 10 shows a flow diagram of an example method of controlling a sintering process; and, FIG. 11 shows an example a method of determining a sintering process endpoint.

Referring now to the flow diagram of FIG. 10, a method 1000 of controlling a sintering process includes activating heating elements to initiate a sintering process in a sintering furnace that contains a green object and a sacrificial object, where the sacrificial object is positioned within the furnace to obstruct a gas port (block 1002). The method also includes monitoring gas flow through a detection channel that extends into the furnace to the gas port (block 1004), and deactivating the heating elements upon detecting a target gas flow through the detection channel (block 1006). In some examples, the method also includes, after activating the heating elements, permitting a predetermined time period to expire before beginning the monitoring (block 1008). In some examples, detecting a target gas flow includes detecting a rate of change of gas flow through the detection channel as the sacrificial object undergoes densification from the sintering process, and detecting a halt in the rate of change of gas flow through the detection channel when the sacrificial object reaches a sintering endpoint (block 1010). In some examples, detecting a target gas flow includes detecting a first flow rate of gas through the detection channel prior to the sacrificial object undergoing densification from the sintering process, detecting a decreasing flow rate of gas through the detection channel as the sacrificial object undergoes densification from the sintering process, and detecting a second flow rate of gas through the detection channel when the sacrificial object reaches a sintering endpoint (block 1012).

Figure 11:
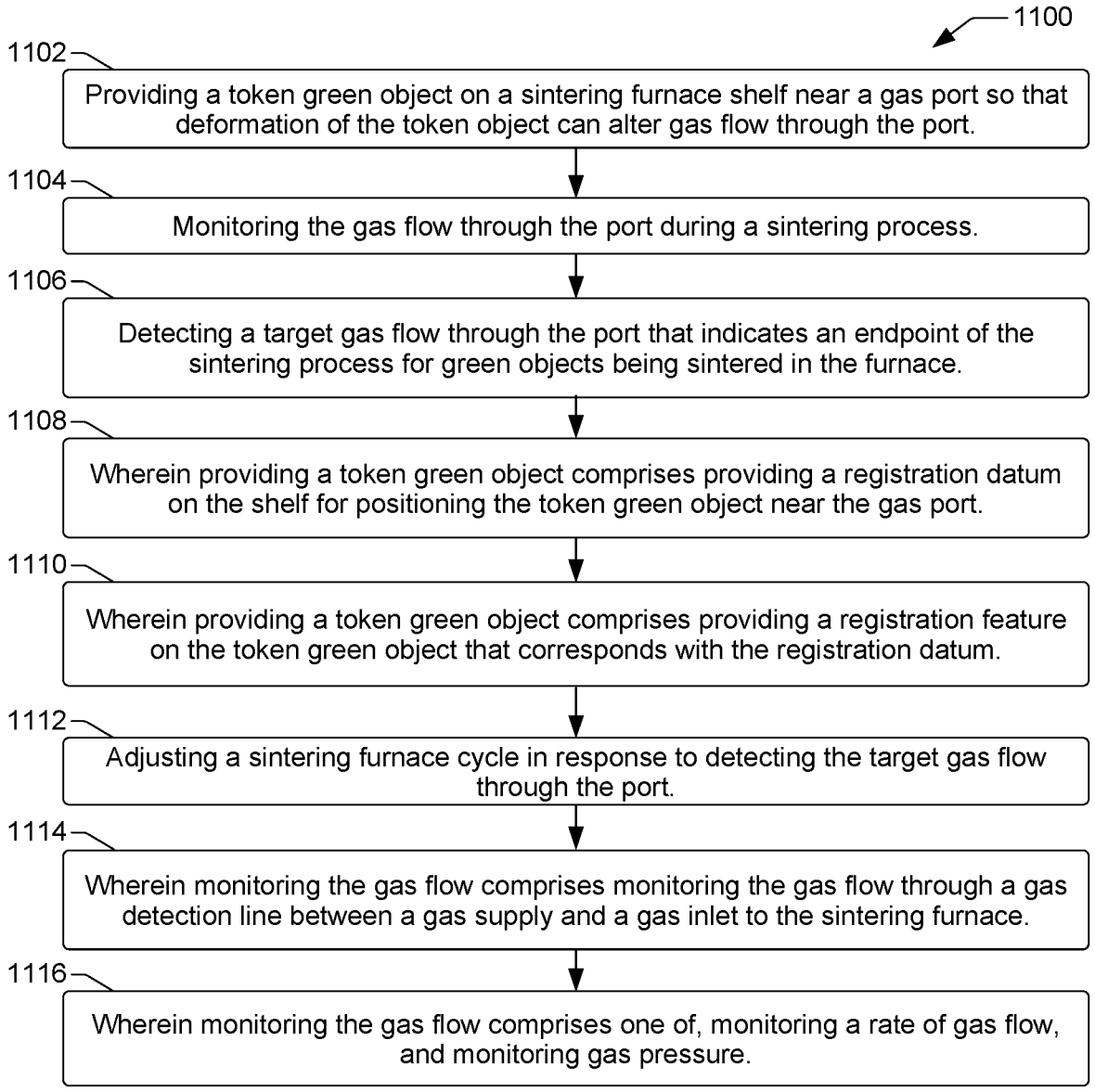

Referring now to the flow diagram of FIG. 11, a method 1100 of determining a sintering process endpoint includes providing a token green object on a shelf within a sintering furnace near a gas port so that deformation of the token object can alter gas flow through the port (block 1102). The method also includes monitoring the gas flow through the port during a sintering process, and detecting a target gas flow through the port that indicates an endpoint of the sintering process for the token green object and for other green objects being sintered in the furnace (blocks 1104, 1106). In some examples, providing a token green object on a shelf can include providing a registration datum on the shelf for positioning the token green object near the gas port (block 1108). In some examples, providing a token green object on a shelf can include providing a registration feature on the token green object that corresponds with the registration datum (block 1110). The method 1100 can also include adjusting a sintering furnace cycle in response to detecting the target gas flow through the port (block 1112). In some examples, monitoring the gas flow can include monitoring the gas flow through a gas detection line outside of a sintering furnace between a gas supply and a gas inlet to the sintering furnace (block 1114). In some examples, monitoring the gas flow can include one of, monitoring a rate of gas flow through the gas detection line, and monitoring gas pressure within the gas detection line (block 1116).

What is claimed is:

1. A sintering system comprising:

a detection gas line to enable gas to flow into a furnace from an external gas supply;

a detection gas port inside the furnace through which gas from the detection gas line is to flow into the furnace;

a registration feature inside the furnace to enable positioning of a token green object proximate the detection gas port;

a gas flow monitor to detect changes in gas flow through the detection gas line when the token green object shrinks during a sintering process in the furnace; and a controller to determine when the changes in gas flow detected by the gas flow monitor reach a target value that indicates that the token green object and other green objects in the furnace have reached a sintering endpoint.

2. A sintering system as in claim 1, further comprising:

a main gas line to enable gas to flow into the furnace from the external gas supply; and, a plurality of gas flow openings in the furnace to allow gas from the main gas line to flow into the furnace and over all green objects in the furnace, including the token green object.

3. A sintering system as in claim 1, further comprising a furnace rack onto which the green objects are to be loaded for sintering in the furnace.

4. A sintering system as in claim 3, wherein:

the furnace rack comprises a frame with shelves coupled to the frame;

the main gas line is routed through the frame to the plurality of gas flow openings that are formed in the frame; and, the detection gas line is routed through the frame and through a portion of a shelf to the detection gas port that is formed in the shelf.

5. A sintering system as in claim 3, wherein the registration feature inside the furnace is disposed on a shelf of the furnace rack.

6. A sintering system as in claim 4, wherein the shelves are adjustable on the frame to enable differently sized green objects to fit onto the shelves.

7. A sintering system as in claim 1, wherein the gas flow monitor comprises a monitor that is operatively coupled to the detection gas line outside of the furnace and is selected from a gas flow rate monitor and a gas pressure monitor.

8. A sintering system as in claim 1, wherein the external gas supply comprises a mass flow controller to provide a constant gas flow rate into the detection gas line.

9. A sintering furnace comprising:

a rack with a frame and shelves to support green objects within a furnace volume;

a gas supply line routed through the frame to provide a continuous gas flow over the green objects;

a monitored gas detection line routed through the frame and through a shelf to provide a monitored gas flow to a detection port formed in the shelf; and, an alignment datum disposed on the shelf to guide placement of a token green object onto the shelf at a location near the detection port so that deformation of the token green object during a sintering process changes the orifice size of the detection port and causes a change in the monitored gas flow.

10. A sintering furnace as in claim 9, further comprising:

a gas flow monitor to monitor the gas detection line and to provide measurements related to gas flowing within the gas detection line; and, a controller to analyze the measurements and to determine when a target measurement has been reached that indicates the green objects in the furnace volume have reached a sintering endpoint.

11. A sintering furnace as in claim 9, further comprising multiple monitored gas detection lines, each monitored gas detection line routed through the frame and through a different shelf to a different detection port formed on a respective shelf.

12. A sintering furnace rack comprising:

a shelf to support objects to be sintered in a sintering furnace;

a frame to support the shelf;

a detection gas line formed in the frame and extending partially through the shelf to provide gas flow to a port formed in the shelf; and, a registration feature on the shelf to guide a token object to a location on the shelf proximate the port such that deformation of the token object during a sintering process alters the port size and changes the gas flow through the detection gas line.

13. A sintering furnace rack as in claim 12, further comprising:

a main gas line formed in the frame to provide continuous gas flow into the sintering furnace; and, multiple gas flow openings formed in the frame to guide the continuous gas flow over the objects during a sintering process.

14. A sintering furnace rack as in claim 12, further comprising:

multiple shelves to support the objects to be sintered; and, multiple detection gas lines, each formed in a different shelf and leading to a distinct port formed in the different shelf.

* * * * *